US005403012A

United States Patent [19]

Stein

[11] Patent Number: 5,403,012

[45] Date of Patent: Apr. 4, 1995

[54] BOARD GAME WITH TRANSPOSING PIECES

[76] Inventor: David E. Stein, P.O. Box 169, Linthicum Heights, Md. 21090

[21] Appl. No.: 276,908

[22] Filed: Jul. 19, 1994

[51] Int. Cl.[6] ..... A63F 3/02

[52] U.S. Cl. ..... 273/261; 273/262

[58] Field of Search ..... 273/243, 255, 242, 260, 273/261, 262

[56] References Cited

U.S. PATENT DOCUMENTS

| | | | |
|---|---|---|---|
| 384,195 | 6/1888 | Duryea | 273/261 X |
| 598,969 | 2/1898 | Anderton | 273/261 |
| 1,373,448 | 4/1921 | Precinauskas | 273/261 |
| 3,533,627 | 10/1970 | Deffenbaugh et al. | 273/261 |
| 3,744,797 | 7/1973 | Hopkins . | |
| 3,963,242 | 6/1976 | Treugut et al. . | |
| 4,339,136 | 7/1982 | Gittings . | |
| 5,014,995 | 5/1991 | Woodward | 273/261 |
| 5,033,753 | 7/1991 | Yuen et al. . | |
| 5,344,153 | 9/1994 | Watanabe | 273/261 X |

FOREIGN PATENT DOCUMENTS

| | | | |
|---|---|---|---|
| 105410 | 10/1938 | Australia | 273/261 |
| 2511883 | 3/1982 | France | 273/261 |
| 2406462 | 8/1975 | Germany . | |
| 2468 | of 1901 | United Kingdom . | |
| 2214092 | 8/1989 | United Kingdom | 273/261 |
| 2239184 | 6/1991 | United Kingdom . | |

*Primary Examiner*—William E. Stoll
*Attorney, Agent, or Firm*—Richard C. Litman

[57] ABSTRACT

A board game for two players includes a game board having a plurality of triangular playing spaces, with the spaces arranged in pairs having alternating light and dark colors or shadings to form a plurality of diamond shaped areas on the board. Two sets of variously configured playing pieces are provided, with one set corresponding to the lighter colored playing spaces and the other corresponding to the darker spaces, although play may take place on any of the spaces for any of the pieces. Each set of playing pieces includes one or more pieces having single or plural space diagonal, lateral and other move patterns. The game also provides for at least some of the pieces to transpose from one color to the other of a pair of playing spaces, whereupon at least one type of playing piece is provided with a different move pattern. Each set also includes at least one playing piece which causes other pieces under its influence to transpose. The rules providing for the transposition of pieces may result in several of the pieces being moved during a single player's turn. The object of the game is to place a specific opponent's playing piece in a capture position, somewhat analogous to the checkmate of chess.

13 Claims, 5 Drawing Sheets

BOARD GAME WITH TRANSPOSING PIECES

FIELD OF THE INVENTION

The present invention relates generally to board games, and more specifically to a game for two players having a board with a plurality of preferably triangular playing spaces in an alternating geodetic array and playing pieces having different move patterns on the board. At least some of the playing pieces can transpose between adjacent alternating spaces and change their move patterns when such transposition occurs, according to the rules of the game.

BACKGROUND OF THE INVENTION

Board games incorporating square or rectangular playing fields with alternating patterns of playing spaces or positions are well known. In some of these games (e.g., checkers) the playing pieces are arranged entirely on one color or shade of playing space, and may never be placed upon the other alternating colored or shaded playing space. In other games using a similar checkerboard pattern (e.g., chess) each set of playing pieces for each player includes pieces which may move from one color or shade of playing position to another; the alternating colors or shades are merely for the purpose of marking the boundaries of each of the positions.

In each of the above games, the rules limiting each of the playing pieces to specific playing positions are quite rigid and inflexible, and in most cases, a piece limited to one pattern of moves may not be transposed from one color or shade of playing position to another. Moreover, no provision is made for a specific playing piece which may cause other playing pieces to transpose, or for multiple moves involving transposition of pieces for one side.

In the interest of a more challenging board game which may require use of all of the playing positions on the game board, a board game is provided which provides for the transposition of most of the different playing pieces from one playing space to another adjacent playing space of a pair of conjugate playing spaces. Most of the individual playing pieces may be transposed by the players of the game as desired, or alternatively each player may control a specialized playing piece which causes other playing pieces to be transposed when such pieces are under the influence of the transposing piece. Accordingly, multiple moves of the various playing pieces may be required during a given player's turn, depending upon the arrangement of the playing pieces, which adds to the challenge of the game in comparison with other known games.

DESCRIPTION OF THE PRIOR ART

U.S. Pat. No. 3,744,797 issued to Mark A. Hopkins on Jul. 10, 1973 discloses a Chess Game Apparatus comprising a plurality of hexagonally shaped playing spaces or positions of three different colors. No transposition of pieces between two spaces comprising a pair of conjugate spaces is disclosed, nor is there any provision for movement of at least two pieces during a single player's turn due to the transposition of pieces, as in the present game.

U.S. Pat. No. 3,963,242 issued to Andreas Treugut et al. on Jun. 15, 1976 discloses a Chess Game For Three People, played on a hexagonally shaped board similar to that of the Hopkins game discussed above. The individual playing spaces may be triangular, as in the present game, but the playing pieces are arranged on adjacent spaces at the start of the game in a manner similar to chess, unlike the present game. No piece transposition is provided.

U.S. Pat. No. 4,339,136 issued to Neil A. Gittings on Jul. 13, 1982 discloses a Board Game Having Triangular Playing Spaces and three different types of specialized playing pieces for each of the two players. The playing pieces do not move similarly to those in chess or to those of the present game, and no transposition of adjacent pieces or multiple piece movement during a single player turn are provided, as in the rules of the present game.

U.S. Pat. No. 5,033,753 issued to Tom Yuen et al. on Jul. 23, 1991 discloses a Method Of Playing A Strategic Board Game, with the board having designated positions allowing a playing piece to be transferred from one of the designated positions to another across the board. No transposition of adjacent playing pieces on conjugate playing positions or spaces is disclosed, nor is any provision for multiple movement of playing pieces due to transposition, as in the present game.

British Patent No. 2468 to Samuel H. Crocker and published on Dec. 14, 1901 discloses an Improved Draught Board comprising sixty triangular playing spaces or positions. The board is used to play a game resembling checkers, in which all of the playing pieces have identical move patterns. No transposition of adjacent pieces or multiple moves due to transposition, is disclosed.

British Patent No. 2,239,184 to Leroy Fenton et al. and published on Jun. 26, 1991 discloses a Board Game in which the game board comprises a plurality of playing positions in a rectangular array. The spaces are positioned on a diagonal to each player, with each of the two players having a set of differently marked pieces. Each piece can move only once along the diagonals of the board, and have identical move patterns, unlike the present game. The object is to form a diamond pattern, unlike the present game.

Finally, West German Patent No. 2,406,462 to Andreas Treugut and published on Aug. 14, 1975 discloses a board game for three persons. This patent provides priority for U. S. Pat. No. 3,963,242 to the same inventor and discussed above. The disclosure appears to be substantially the same as the U.S. Pat. No. '242, and hence has no particular bearing upon the present game.

None of the above noted patents, taken either singly or in combination, are seen to disclose the specific arrangement of concepts disclosed by the present invention.

SUMMARY OF THE INVENTION

By the present invention, an improved board game for two players is disclosed.

Accordingly, one of the objects of the present invention is to provide an improved board game which includes a game board formed of a plurality of triangular playing spaces in a geodetic array of alternating colors or shades, with pairs of triangular spaces having coincident bases and forming conjugate playing spaces.

Another of the objects of the present invention is to provide an improved board game which includes two sets of playing pieces of different colors or shades, with each set having a plurality of different pieces providing for different patterns of moves on the game board.

Yet another of the objects of the present invention is to provide an improved board game which provides for the transposition of one or more playing pieces in opposite playing spaces of a conjugate pair of playing spaces.

Still another of the objects of the present invention is to provide an improved board game which provides at least one special playing piece for each set, which causes the transposition of other playing pieces from time to time according to the game rules.

A further object of the present invention is to provide an improved board game which special playing pieces may not be captured during the course of play.

An additional object of the present invention is to provide an improved board game which provides different move patterns for at least some of the playing pieces, depending upon whether or not they have been transposed.

A final object of the present invention is to provide an improved board game for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 2:
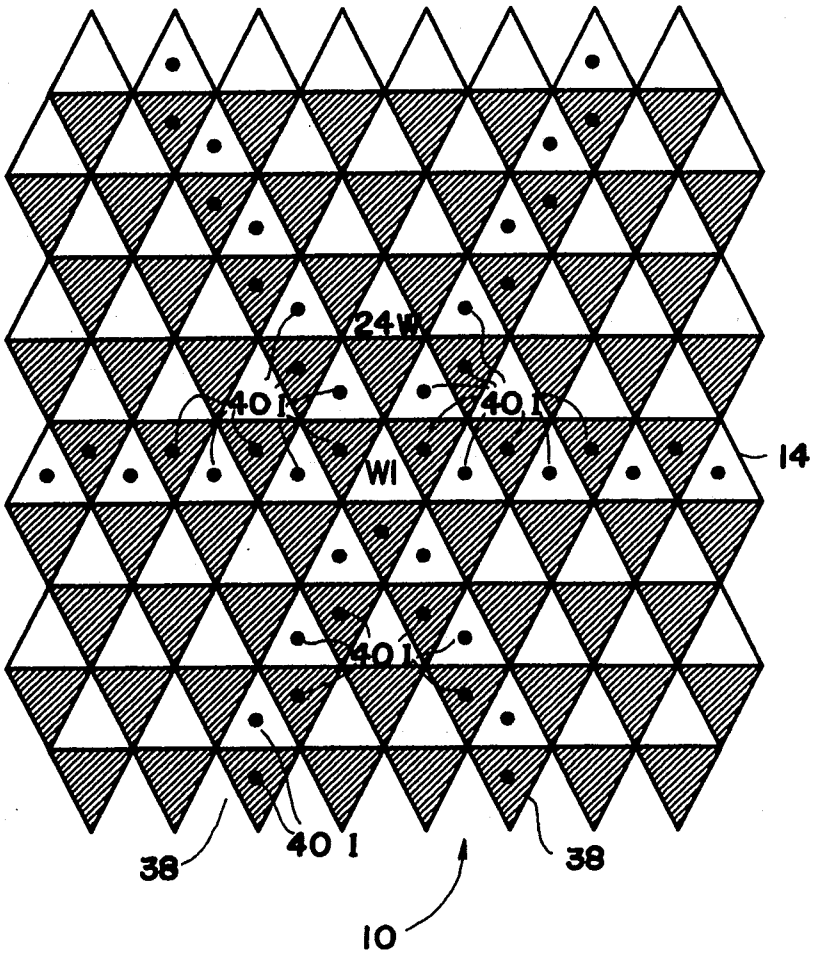
FIG. 2 is a plan view of the game board, showing the movement pattern for an "Iynx" playing piece of the present game.

Referring now to the drawings, the present invention will be seen to relate to a board game wherein one or more adjacent playing pieces or position markers in adjacent positions or spaces forming a conjugate pair may be transposed with one another. In certain instances, more than two transpositions may be made simultaneously, depending upon the movement of other player position marker(s).

Figure 1:
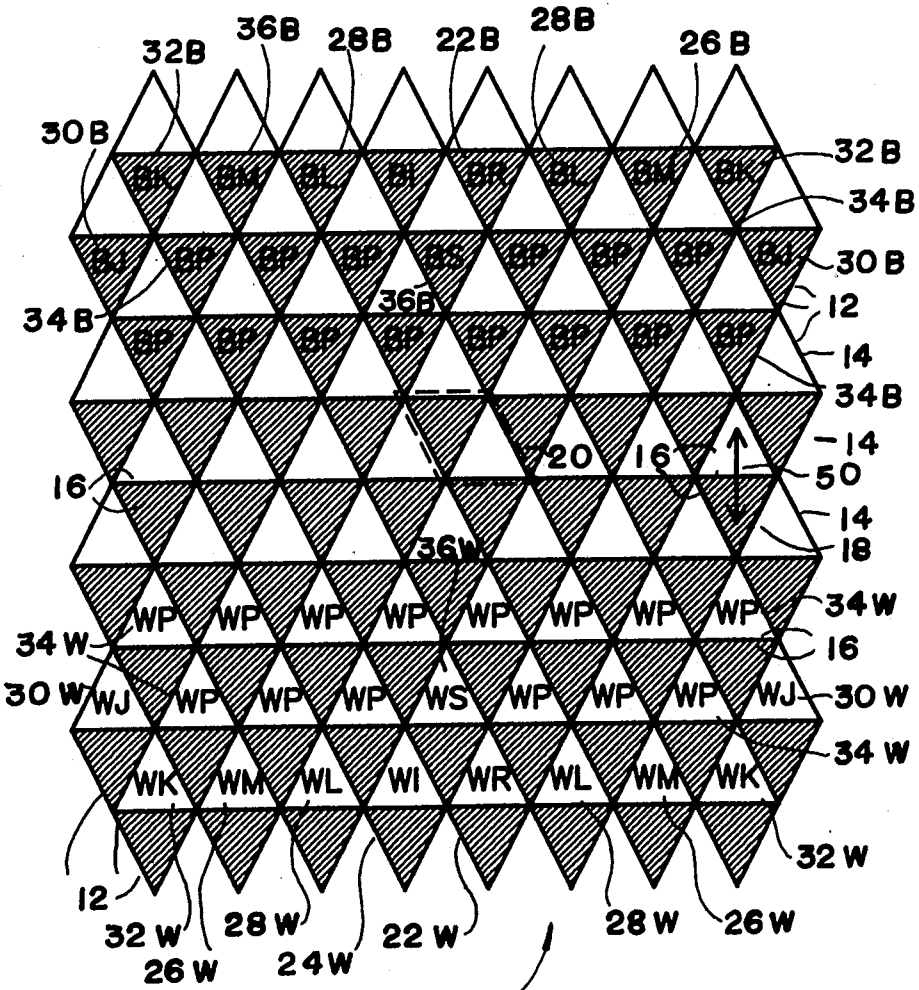
FIG. 1 is a plan view of the game board of the present board game, showing the starting position for the two sets of playing pieces for the present game, and other details relevant to play.

FIG. 1 provides a plan view of the game board 10 of the present game, as well as showing the starting array of the two opposite sides or groups of player position markers. The game board 10 is formed of a plurality of triangular playing positions or spaces 12 in alternating light and dark shades or colors, in a geodetic array to form a plurality of lateral ranks 14. Each of the triangular spaces 12 includes a base side 16 which is parallel to the lateral ranks 14, with the bases 16 of each rank 14 of spaces 12 defining the upper and lower limits of each respective rank 14. Pairs of triangular spaces 12 having common or adjacent base sides 16 and positioned in adjacent ranks 14 form conjugate pairs 18 with each triangular space of the pair 18 having a different shade or color than the other, as shown by the example outlined in heavier lines in FIG. 1. (Other adjacent triangular space pairs on the same rank 14, e.g. the pair outlined by the broken line border 20, are not considered to be conjugate according to the rules of the present game. It will be understood that the heavy line border around the conjugate space pair 18 and the broken line border 20 around the non-conjugate space pair are exemplary only and do not necessarily appear on an actual game board.)

Preferably, the board 10 of the present game comprises eight full ranks 14 of seventeen triangular spaces 12 each, and opposite first and second sides 22 and 24 of eight spaces 12 each, for a total of 152 spaces 12. Other configurations may be used if desired. As noted above, each triangular space 12 is surrounded by other spaces 12 having a different shading or color. Black and white may be used, or alternatively any contrasting shading or colors to differentiate between adjacent triangular spaces 12, particularly spaces 12 forming conjugate pairs 18.

Two sets or groups of playing pieces or player position markers are provided respectively for a first player and a second player, with the two groups being differentiated by shading or color, as in the board spaces 12 discussed above. Preferably, each group or set is colored or shaded to closely match the respective positions or spaces 12 on which they are placed to form a starting array, as shown in FIG. 1. Generally, the letters "W" and "B" are used throughout the present disclosure to designate respectively "White" and "Black," but it will be understood that different shades or colors may be used as desired.

Each of the groups or sets of position markers includes a "Ra" piece or marker 22W (for the "white" pieces) or 22B (for the "black" pieces), which Ra marker 22W/22B has a function loosely analogous to the king of chess, in that the object of the game is to trap or capture the opposite side's Ra marker so that no legal move remains for the Ra. This is called "checkmate," as in chess, with the player performing the checkmate being the winner of the game. However, the moves of the Ra are not at all similar to the moves of a chess king on a board of square playing spaces; the specific move pattern of the Ra will be discussed further below.

In addition to the Ra marker 22W/22B discussed above, each group also includes an "Iynx" piece or player position marker 24W/24B; two "Mynx" markers 26W/26B; two "Lynx" markers 28W/28B; two "Jynx"

markers 30W/30B; two "Kynx" markers 32W/32B; a plurality (preferably fourteen) of "Point" markers 34W/34B; and finally, a "Sphynx" marker 36W/36B. (The specific quantities of the above pieces may be varied if desired.) The specific move patterns of each of the above pieces or player position markers 22W/22B through 36W/36B will be discussed below.

FIG. 2 discloses a plan view of the present game board 10, with a white Iynx player position marker 24W thereon. The Iynx markers 24W (and 24B) are permitted to move to any board space or position 12 along any of the ranks 14 or diagonals 38 of the board, as indicated by the dots 40I in the rank 14 and diagonals 38 extending from the Iynx marker 24W in FIG. 2. (While a white Iynx marker 24W is shown in FIG. 2, it will be understood that the permitted move pattern for the black Iynx marker 24B is identical, the only difference being the color or shade of the board space or position 12 on which the two markers 24W/24B are positioned at the start of the game.) Thus, either of the Iynx markers or pieces 24W/24B may move to either color or shade of board space or position 12, and are not restricted to board spaces or positions of their own color or shade. The only restriction upon the movement of the Iynx markers 24W/24B is when another piece is positioned along the rank 14 or diagonal 38 along which the Iynx marker 24W/24B is to move; the Iynx markers are not permitted to jump over any other pieces or markers (capturing of an opponent's marker on a space to which the Iynx marker is moved is permitted, however).

Figure 3:
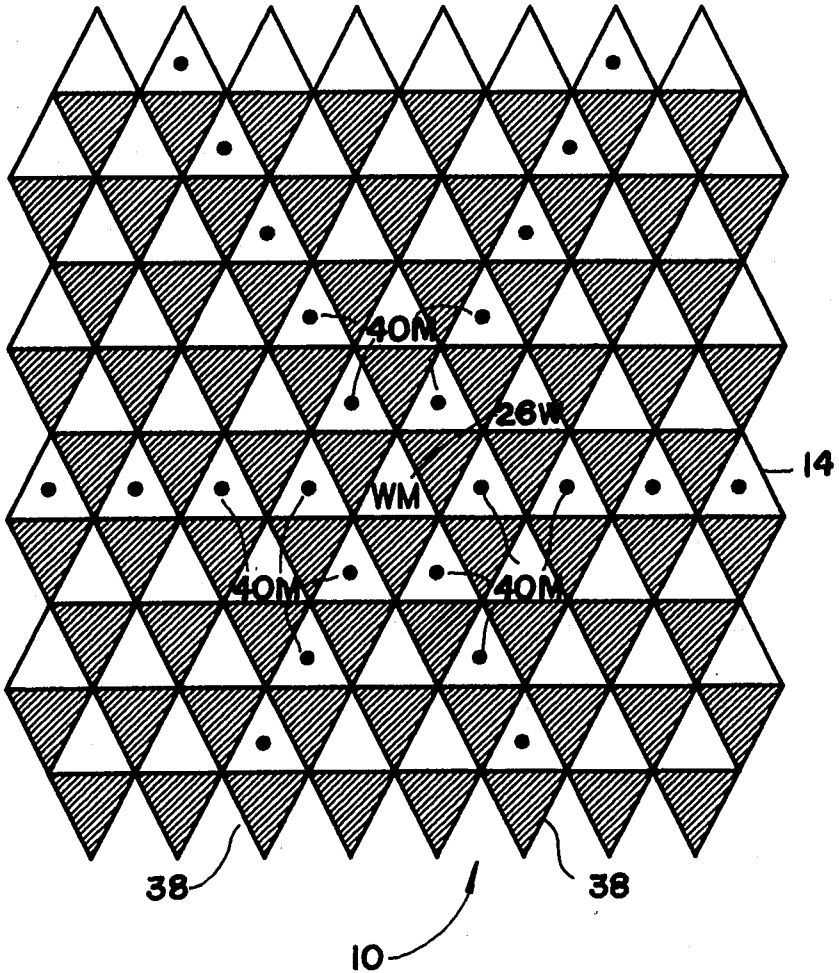
FIG. 3 is a plan view of the game board, showing the movement pattern for a "Mynx" playing piece.

FIG. 3 discloses the move pattern for a Mynx piece or player position marker 26W. The white Mynx marker 26W will be seen to have a similar move pattern to the Iynx markers 24W/24B discussed above, i.e., along the ranks 14 and diagonals 38 of the board 10, with the exception that the Mynx markers 24W/24B are restricted to board positions or spaces of like color or shading to that of their starting position for the game (i.e., a white Mynx is restricted to white spaces, and a black Mynx is restricted to black spaces). The specific moves available to the white Mynx marker 26W of FIG. 3 are indicated by the dots 40M on the board 10.

However, an exception is made to the above restriction when any of the Mynx pieces or markers 24 are transposed with any other piece across a pair of conjugate spaces, which procedure is discussed further below. Accordingly, any of the Mynx markers 24W/24B may pass over any other pieces located along the rank 14 or diagonals 38 along which the Mynx marker is to be moved, so long as the other marker(s) or piece(s) is/are located only on board spaces or positions which are of a different color or shade than that of the space from which the move is begun.

Figure 4:
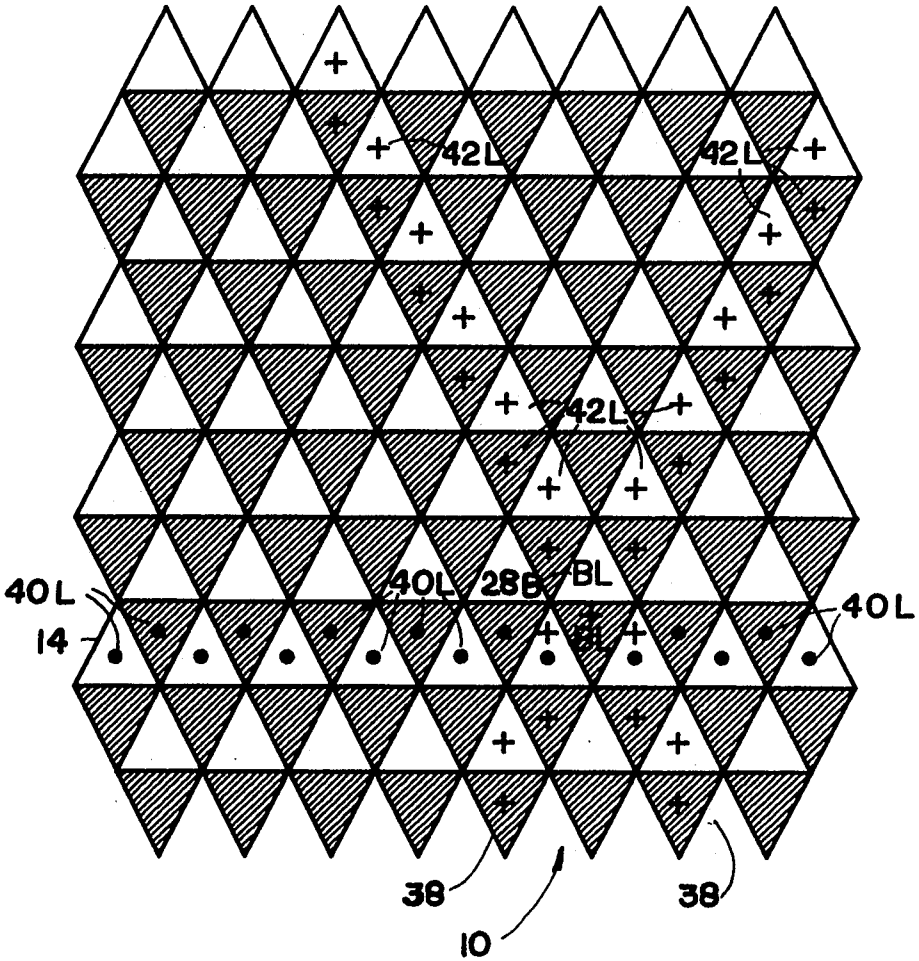
FIG. 4 is a plan view of the game board, showing the two movement patterns for a "Lynx" playing piece, depending upon the type of playing space from which the move is started.

FIG. 4 discloses a board 10 showing the permitted move pattern for a Lynx player position marker, in this case a black Lynx 28B. The Lynx markers 28W/28B have two different permitted patterns of movement, depending upon the color or shade of the starting position for the move. If the starting position is from a space of like color or shade to that of the Lynx piece or marker, then the Lynx is permitted to move only laterally, to any of the spaces (of any color or shade) along that rank 14, as indicated by the dots 40L. A Lynx thus may end a move on a position of like or dissimilar color or shade, as access to any of the positions (of either color or shade) along the rank 14 is permitted. However, if the Lynx marker starts its move from a space of dissimilar color or shade, as indicated by the uppermost black Lynx 28B of FIG. 3, then movement is permitted only along the diagonals 38 from which the move is begun, as indicated by the cross marks 42L of FIG. 3. Again, all of the positions (of either shade or color) along the diagonals 38 are permitted moves, as in the case of movement along the ranks 14 when the Lynx begins a move from a position of like shade or color; the Lynx may not jump over any other pieces.

Figure 5:
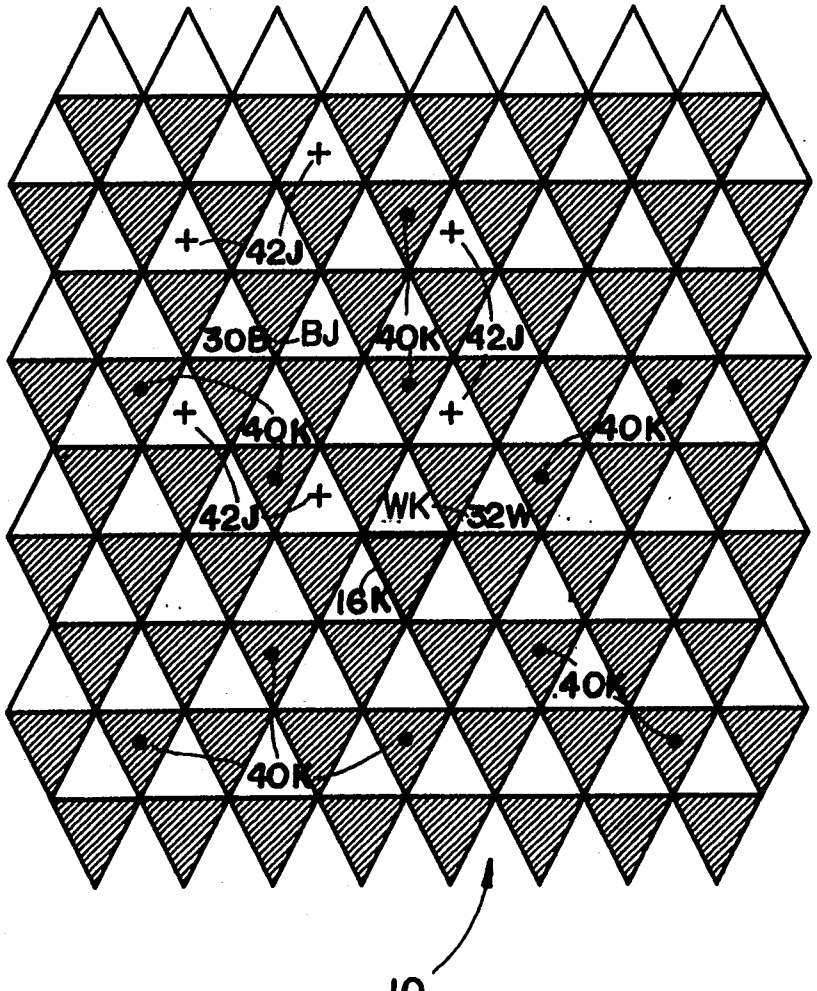
FIG. 5 is a plan view of the game board, showing the movement patterns for the "Jynx" and "Kynx" playing pieces of the present game.

In FIG. 5, the permitted move patterns for the Jynx pieces or markers 30W/30B and Kynx markers 32W/32B are shown. Generally, the two markers 30W/30B and 32W/32B have similar move patterns, in that they are each generally hexagonal in form. It will be seen that when starting from any given position, that a first hexagonal matrix of six other positions of like color or shading are immediately adjacent to and surround the given position, forming a hexagonal pattern with apices oriented toward the lateral sides of the board 10. A second hexagonal matrix is formed by the next series of like shaded or colored spaces out from the given position, with the hexagonal pattern rotated by thirty degrees to place the apices toward the two player or opponent sides of the board 10. This second hexagonal matrix of spaces centered upon the starting position for the Jynx piece (e.g., the black Jynx player position marker 30B of FIG. 5) forms the permitted move pattern of a Jynx marker, as indicated by the crosses 42J of FIG. 5. (It will be noted that a Jynx marker always terminates its move on a position of like color or shading as that from which the move was started. However, a black Jynx marker 30B is shown on a lighter position or space in FIG. 5. This may be accomplished by transposing the Jynx marker between conjugate spaces, which procedure is explained further below.)

The movement pattern of the Kynx player position marker 32W/32B is somewhat more complex, but is based upon the same hexagonal format as that described above for the Jynx marker 30W/30B. Essentially, two concentric hexagonal patterns are formed, with each centered upon the conjugate space to the starting position of the Kynx marker 32W/32B, e.g., space 16K (marked in a heavier border for the purposes of illustration) which is conjugate to the space containing the Kynx marker 32W of FIG. 5. The first hexagonal matrix of permitted moves for the Kynx 32W/32B will be seen to be identical to the permitted move pattern for the Jynx markers 30W/30B, but centered on the adjacent conjugate space.

However, a second, larger hexagonal move pattern matrix is also permitted for the Kynx 32W/32B, with the spaces for the second hexagonal matrix being displaced two more spaces outward from the move pattern spaces of the first hexagon pattern. The permitted move pattern for the Kynx marker 32W/32B is shown by the dots 40K in FIG. 5. (Only eleven of the twelve theoretical move positions are shown, as the lowermost position falls off the lower edge of the board.) It will be noted that, due to the hexagonal patterns being centered on the conjugate space of a different color or shade than the starting space for the Kynx move, that each time a Kynx marker 32W/32B moves, the move is terminated on a space of a different color or shade from that of the starting space.

Both the Kynx markers 32W/32B and Jynx markers 30W/30B are permitted to jump or pass over all other markers or pieces disposed between their starting and terminating move spaces. Capture of other pieces is made conventionally, by terminating the move on the space held by the other piece or marker, and removing that other piece or marker from the board; all captures of the present game are made in this fashion.

Figure 6:
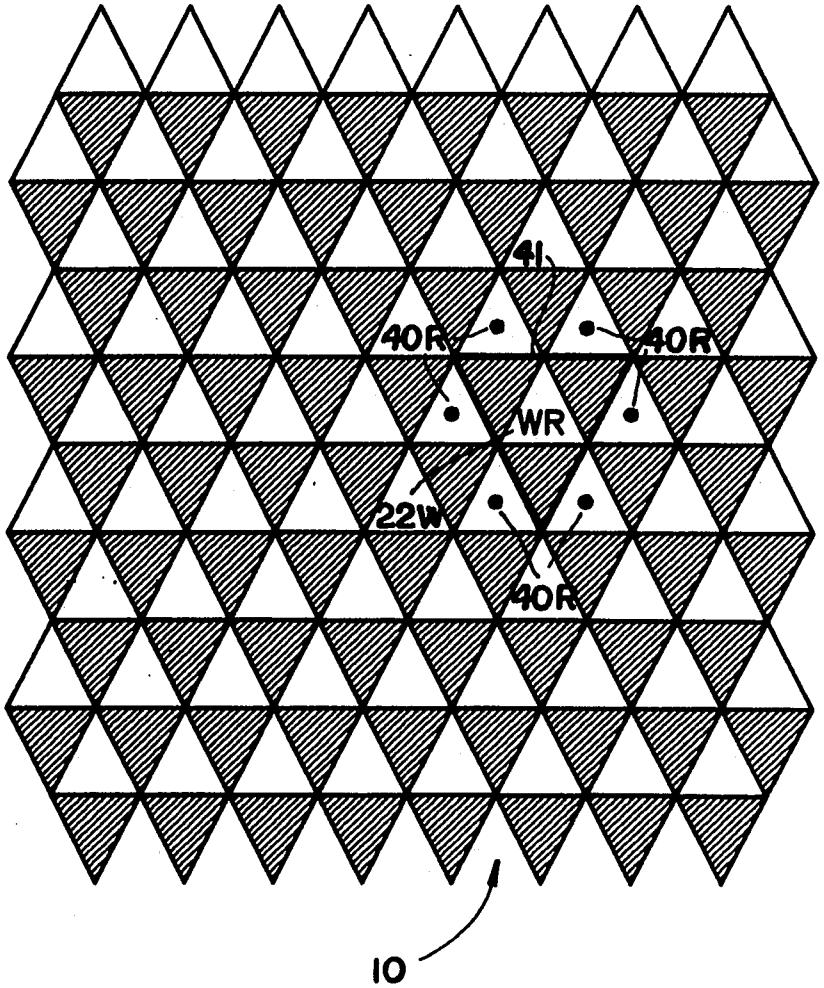
FIG. 6 is a plan view of the game board, showing the movement pattern for the "Ra" of the present game, and the triangular area or "shield" surrounding the Ra in which opponent playing pieces are immobilized.

FIG. 6 discloses the permitted move pattern for the Ra 22W/22B. Six possible spaces are provided for each Ra move, in the form of a hexagonal pattern formed of the board spaces of like color or shade immediately adjacent to the starting space for the move, as indicated by the dots 40R in a hexagonal array surrounding the white Ra 22W. (As in the case of all other pieces or markers, fewer moves may be available due to other markers—either "friendly" or opponent—or the edges of the board restricting the maximum possible number of positions available.) As in the case of other markers or pieces which are restricted to move patterns which are discontinuous from the starting position, the Ra 22W/22B is permitted to jump or pass over any other pieces located on the alternately colored or shaded spaces between the starting and terminating position. The Ra 22W/22B will always terminate its move on a space of the same shade or color as that from which the move is started, as in the case of the Mynx 26W/26B and Jynx 30W/30B discussed above. However, while those pieces may transpose from one color or shade of board space to a conjugate space of a different color or shade, in accordance with the rules discussed further below, the Ra 22W/22B remains on the same color or shade of board space as its starting position, throughout the entire game; no Ra transposition is permitted.

The Ra 22W/22B serves a function similar to that of the king in the game of chess, in that it is not allowed to be captured or removed from the board. An attack on a Ra marker 22W/22B by an opposing piece, where the Ra could be taken at the next move, is analogous to a check in chess, where a king is attacked in a similar manner. The Ra 22W/22B is obligated to remove the attack in some manner, by moving, interposing another piece or capturing the attacking piece, as in chess, or transposing the attacking piece, which procedure is discussed below. If no legal move allows the Ra to remove the attacking threat (thus making capture and removal of the attacked Ra a certainty on the next move), the Ra is considered to be checkmated and the game is over, with the player performing the checkmate being the winner.

The Ra player position markers 22W/22B are permitted one additional advantage over other pieces or markers: When an opposing marker is positioned in one of the three spaces of a different color or shade than the space upon which a Ra is positioned and immediately adjacent to that space, it is no longer permitted to move, but must remain in that space until the Ra is moved away. ("Friendly" pieces in these spaces may move normally.) This three space matrix is known as "Ra's Shield," and will be seen to remain about each Ra marker 22W/22B as the respective Ra player position marker is moved about the board. An example of such a shield is shown by the heavy line border 41 surrounding the white Ra 22W and adjacent spaces in FIG. 6. Moreover, the two opposing Ra pieces are allowed to move to spaces immediately adjacent to one another, unlike chess, or in other words to enter one another's "shields". This is permitted, as neither Ra marker may capture the other, as they each must remain respectively on spaces of similar color or shade throughout the entire game and are not permitted to move or transpose to a space of unlike color or shade, as can all other pieces or markers. However, if such a situation occurs, both Ra markers 22W/22B will be immobilized for the remainder of the game, as each will be in the other's shield area, and thus will not be able to move.

Figure 7:
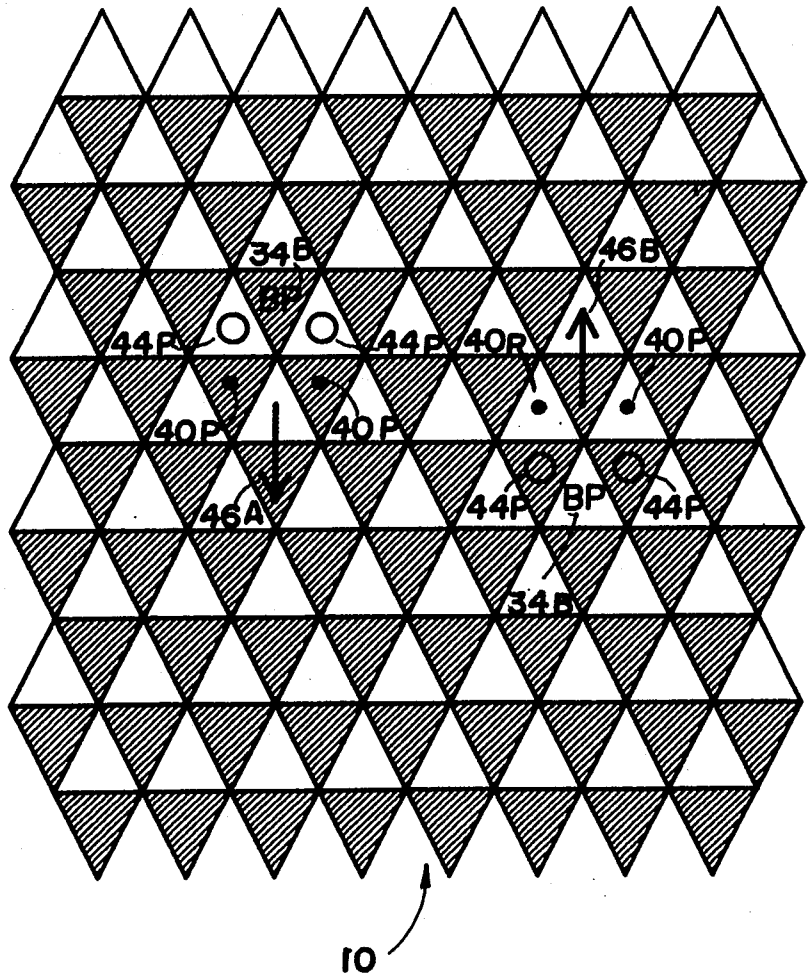
FIG. 7 is a plan view of the game board, showing the movement pattern for the "Points" of the present game, depending upon the type of playing space from which the move is started.

The movement patterns for the "Point" player position markers or pieces 34W/34B are shown in FIG. 7. The Point markers 34W/34B have two different move patterns, a capturing move pattern and a non-capturing move pattern. Assuming the Point 34W/34B is not capturing an adjacent opponent's piece, the Point marker 34W/34B is permitted to move one diagonal space on each move, to a space of like color or shading from the starting space, as indicated by the dots 40P of FIG. 7. Thus, the Point markers 34W/34B will normally remain on the same color or shade of space from which they started the game, unless a transposition or capturing move is made.

However, the number of spaces which may be used in a capturing move by a Point 34W/34B are doubled from those of a non-capturing move. The Point 34W/34B may capture by moving diagonally to one of the spaces marked by the dots 40P, as in the non-capturing moves discussed above, or alternatively may be moved laterally one space along the same rank as the starting position for that move, as indicated by the circles 44P of FIG. 7.

However, the direction of travel of the Points 34W/34B across the board 10 will reverse in such a lateral capturing move, depending upon the color of the board space upon which the Point 34W/34B commences its move. The two black Points 34B shown in FIG. 7 will have begun play from the dark or black spaces in an array at the upper side of the board 10, as viewed in FIG. 7. Thus, their initial direction of movement is toward the opposite, lower side of the board 10, as indicated by the leftmost black Point and the accompanying directional arrow 46A. However, in the event a lateral capture move or transposition is made, the black Point will terminate the move on a lighter or white space, as indicated by the rightmost black Point 34B of FIG. 7.

Henceforth, its direction of travel will be reversed, back toward the side of the board from which it started, so long as it remains on spaces of a different color or shade from its space at the start of the game. This reversed direction of travel for the rightmost black Point 34B of FIG. 7 is shown by the directional arrow 46B. It will be understood that, although only black Points 34B are shown to illustrate the rules of movement of the Points, that the direction of movement on the board 10 of FIG. 7 would be reversed for white Points 34W in the above examples. To generalize the above rule, all Points 34W/34B which commence a move from a space having like color or shading as that of the Point marker 34W/34B (or in other words, the same color or shading as that of the space upon which the Point 34W/34B started the game), will move from its own side toward the opposite or opponent's side of the board 10. All Points 34W/34B which commence a move from a space having a different color or shading as that of the Point marker 34W/34B (i.e., different from initial starting space for the game), will move back toward its own starting side from the direction of the opposite or opponent's side of the board 10. If a Point 34W/34B traveling toward its own side reaches the edge of the board, it is transposed to a space of similar color or shading and again proceeds forward across the board toward the opponent's side.

The Points 34W/34B are permitted an additional, very valuable operation: Upon reaching the opponent's edge of the board 10, a Point 34W/34B may be exchanged (or promoted) for any other higher ranking piece or marker (excepting the Ra). This is somewhat analogous to the pawn promotion of chess, but the Points of the present game are permitted to travel back and forth across the board 10 innumerable times during a game, so long as they do not actually reach the opponent's edge of the board or are not captured or otherwise prevented from moving. An opponent wishing to stop a Point from reaching his/her side of the board and making such a promotion may cause the transposition of the Point, as discussed below, rather than capturing and removing it from the board, depending upon the circumstances. The transposition of the Point will cause the Point to reverse direction, as described above, thus moving away from the opponent's edge of the board when a move is made and reducing the danger of Point promotion to a higher ranking piece.

Figure 8:
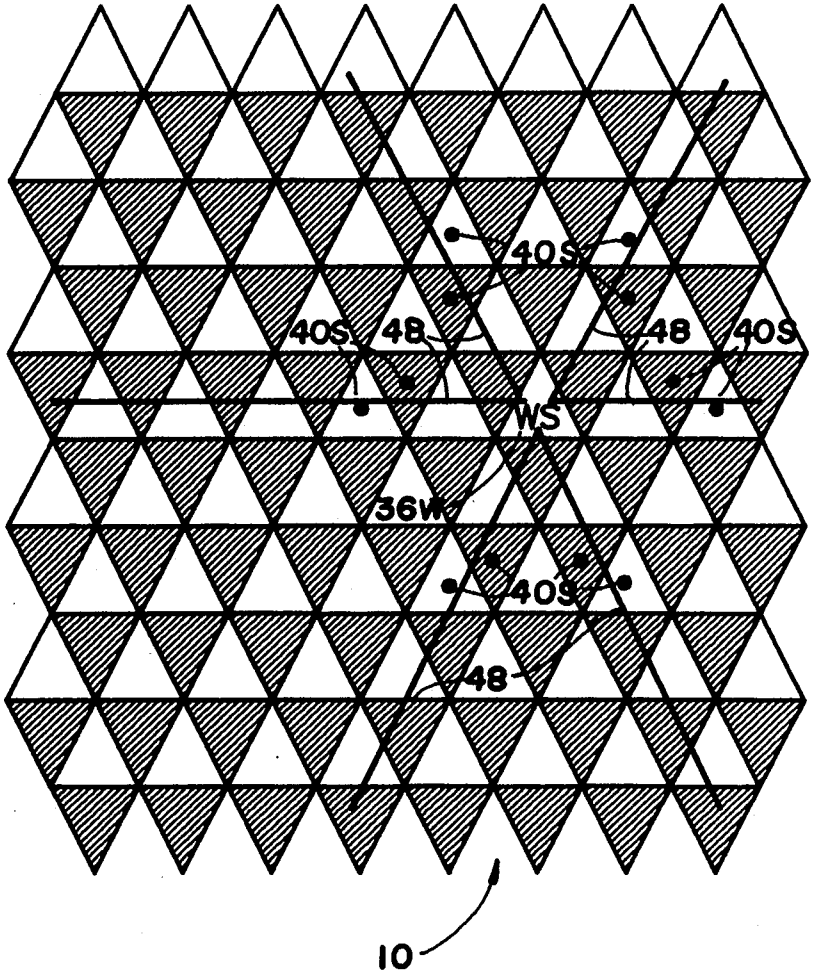
FIG. 8 is a plan view of the game board, showing the movement pattern for the "Sphynx" of the present game, and its paths of transposition influence.

The final piece or player position marker to be discussed is the Sphynx 36W/36B, which movement pattern is illustrated in FIG. 8. The permitted pattern of movement of the Sphynx 36W/36B comprises the third and fourth spaces in each of the four diagonal directions and two lateral directions from the originating space for the move. Thus, the pattern is generally hexagonal, with each of the six apices of the hexagonal matrix having two adjacent spaces for a total of twelve permitted spaces for each move of the Sphynx marker 36W/36B. The twelve permissible spaces for the white Sphynx of FIG. 8 are shown by the dots 40S. (It will be noted that, while the white Sphynx 36W of FIG. 8 is shown on a white space, that the Sphynx markers 36W/36B may just as easily be moved to a space of a dissimilar color or shade, by moving to the nearest allowable space during a move, rather than the farthest.)

The Sphynx markers or pieces 36W/36B are provided with unique powers in the present game. First, they may never capture another marker or piece, nor may they be captured. (However, the rules of the present game may be modified to permit such if desired.) Secondly, each Sphynx 36W/36B radiates lines of influence along the diagonals and ranks of its possible directions of movement, as indicated by the lines of influence 48 extending from the white Sphynx 36W of FIG. 8. These lines of influence are in effect only during the time immediately following the movement of a Sphynx 36W/36B, whereupon they cease to have any effect or influence on the game. The lines of influence cause any pieces (white and black both) to be transposed, or moved from whichever space upon which they are located, to the adjacent conjugate space of a different color or shade (the Ra being excepted). Lines of influence extend only until they reach a marker or piece positioned along that line, whereupon they cause the transposition of that piece or marker (and another marker, if any, positioned on the conjugate space). Other pieces which are "downstream" or farther removed from the first marker or piece in the line of influence, are unaffected and remain in place.

Once all pieces or markers affected by the lines of influence of the newly moved Sphynx 36W/36B are transposed, the lines of influence are no longer in effect; they affect transposition of other markers or pieces only immediately following a move of a Sphynx 36W/36B. It will be seen that the use of the Sphynx markers 36W/36B can be of use, e.g., when a piece is under attack or the Ra is checked, it may be possible to move a Sphynx 36W/36B to cause the attacking piece to be transposed, and thus remove the threat by displacing the attacking piece to the second of two conjugate spaces forming a conjugate pair, as shown in FIG. 1.

The present game also makes use of the conjugate spaces, e. g., the pair of spaces outlined by the heavier border 18 of FIG. 1, in other ways. Even without play or movement of the Sphynx markers 36W/36B, players may transpose or "swap" adjacent markers or pieces in adjacent spaces of a conjugate pair, if desired, as indicated by the transposition arrow 50 of FIG. 1. Such transposition is restricted to occasions when there are two pieces or markers in adjacent spaces of a conjugate pair, unlike the situation in which the Sphynx 36W/36B may cause transposition of a single piece from one space to the other of a conjugate pair. The "swapping" or transposing of pieces without use of the Sphynx 36W/36B is restricted to two pieces within a single conjugate pair of spaces, and comprises a move for the player making the transposition; no other move may be made during that player's turn. Any two pieces (with the exception of the Ra 22W/22B, as described further above) may be transposed, so long as at least one of the pieces belongs to the player making the transposition. In other words, both pieces may belong to that player, or only one piece may belong to that player, with the second piece of the transposing pair belonging to the opponent.

Transposition or "swapping" may also be performed for a single piece. This situation enables a piece to make a move between conjugate spaces which move would otherwise fall outside that piece's standard move pattern. The transposition is performed in lieu of a standard, non-transposing move.

The present game is played in accordance with the above described rules of movement for the various pieces or markers 22W/22B through 36W/36B, with the pieces or markers being set up on the board 10 as shown in FIG. 1 and first and second players chosen. The provision of the game board 10, setup of the player position markers or pieces, and player selection are described generally in step 1 of the flow chart of FIG. 9. The white or lighter colored or shaded pieces or markers are permitted to move first, hence the first player will play those pieces with the second player using the darker colored or shaded pieces or markers. The two players will alternate moves, selectively moving their Ra, Iynx, Lynx, Mynx, Jynx, Kynx, and Point markers or pieces in attempting to checkmate the opponent's Ra piece or marker, to preclude any legal moves for that Ra marker or that player's markers to prevent capture of the Ra. Each player may capture the other player's pieces or markers or otherwise attempt to gain an advantage during the game, as indicated in step 3 of FIG. 9.

In many situations, there may be two markers or pieces in adjacent, conjugate spaces on the board, and it may be advantageous for a player to transpose or "swap" these two markers with one another. This may provide better alignment for one of the pieces to attack one of the opponent's pieces, or conversely may serve to remove a piece from an attacking line from an opponent's piece. A player may transpose pieces entirely of his/her own side (i.e., both may be "Black" pieces or both may be "White" pieces), or may transpose one of his/her pieces or markers with an opponent's piece or marker on the other space of the conjugate pair. A player may not transpose two of the opponent's markers; at least one marker or piece must be of the player who is making the transposing move. This is generally described in the optional step 4 of FIG. 9.

Figure 9:
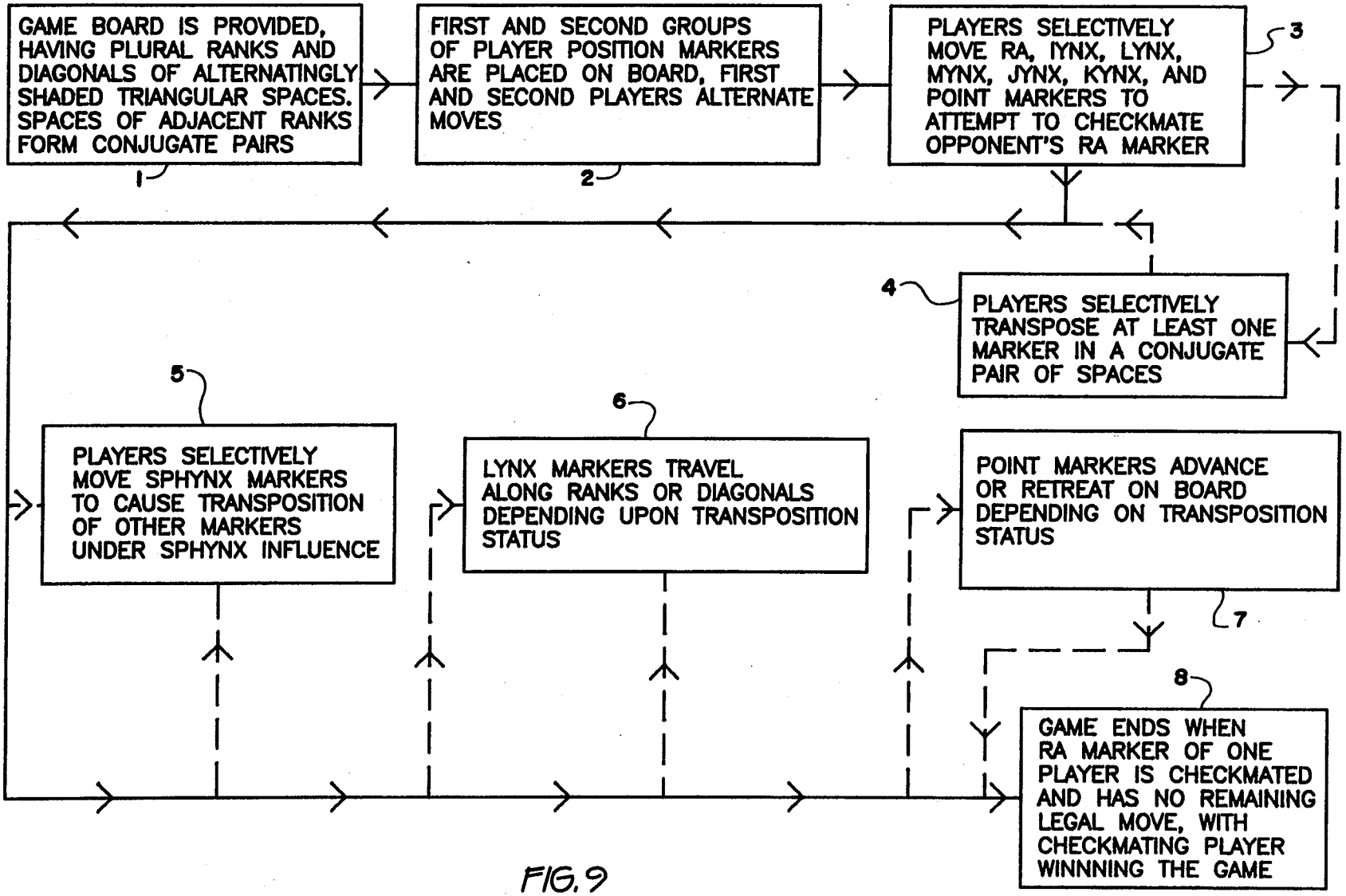
FIG. 9 is a block diagram or flow chart showing the rules and steps in the method of play of the present game.

In some cases, particularly as the game begins to open up and various pieces are captured on either side and removed from the board, it may be advantageous to employ the "Sphynx" marker, as indicated in the optional step 5 of FIG. 9. When one of the Sphynx markers is employed, it will cause the transposition of the closest pieces (of both players) which are on the same rank or one of the same diagonals as that to which the Sphynx is moved (with the exception of the Ra of either player). This may have the same advantages as described above for the basic transposition move, in that it may move a player's piece(s) to attack an opponent's piece(s), or alternatively may remove that player's piece(s) from attack. Conceivably, situations may arise where both cases may occur, due to the simultaneous multiple moves which may be caused by a Sphynx move. Theoretically, with lines of influence radiating outward in both directions along two diagonals and a rank, there will be six different lines of influence from a newly moved Sphynx. If the closest markers or pieces all comprise conjugate pairs (other than the Ra) along these lines of influence, there may be a total of thirteen pieces moved by a single player on one move: The Sphynx, and the six pairs of markers along each of the lines of influence. As can be seen, the Sphynx can be an extremely powerful playing piece, capable of changing the entire complex of the game. Moreover, the Sphynx is the only piece which does not capture other pieces, and the only piece (other than the Ra) which cannot be captured; its sole power is to cause the transposition of other pieces, immediately following a Sphynx move.

When the Lynx marker is moved, its movement path will depend upon whether or not its move is initiated from a space of like color or shade to the particular Lynx being moved (i.e., its own "world,") or from a dissimilarly colored or shaded space (i.e., the "hostile world"). A Lynx beginning a move from a like colored or shaded space may move only laterally along the same rank as that in which it started the move. On the other hand, if it begins the move from a space of the "hostile world" (dissimilar color or shade), then it may move only along the diagonals. This movement pattern is indicated in the optional step 6 of FIG. 9.

As the Point markers are advanced from either side, they will initially generally move toward the opponent's side of the board (excepting purely lateral moves), as they will be initiating the moves from spaces of their own "world." However, a purely lateral move or a transposition will cause a point to move to a space of the "hostile world" (i.e., having a dissimilar color or shading to the Point marker) and thence the Point marker is required to move back toward that player's side of the board (again, excepting purely lateral moves). A Point may make such reversals several times during the course of a game, until the end of the game or until the Point reaches the opponent's side of the board and is promoted. This is generally shown in optional step 7 of FIG. 9.

The above alternating movements of the various markers or pieces of the game by the two opposing players continues until such time as the Ra marker of one player is under attack (or "in check") to such an extent that the player being attacked has no further legal moves for his/her Ra or for any other of his/her markers or playing pieces (e.g., to block an attacking line or capture an attacking piece with another piece). This is a "checkmate," with the player performing the checkmate being the winner of the game, as shown in step 8 of FIG. 9. While the various steps 4 through 7 are described as being optional, it will be seen that while these steps are not essential to the play of the game, they will generally be implemented in the majority of games at some point or another.

The above described game, while including some elements which loosely resemble a few elements of the game of chess, will be seen to provide a board game which is vastly more challenging due to the transposition of adjacent pieces or markers on conjugate playing spaces of the board, the different movement pattern of at least one of the playing pieces depending upon which type of space from which the move is started, and the inclusion of a unique playing piece which may neither capture or be captured, but which may cause the simultaneous transpositional movement of several other pieces on the board, thereby potentially changing the entire complexion of the game. The present game will be seen to provide a fresh and novel board game for those who seek additional challenges over chess and other such board games.

It is to be understood that the present invention is not limited to the sole embodiment described above, but encompasses any and all embodiments within the scope of the following claims.

I claim:

1. A method of playing a board game involving the transposition of playing pieces in pairs of conjugate triangular playing spaces of a game board, said method comprising the following steps:

providing a game board comprising a plurality of triangular playing spaces of alternating first and second shades in a generally rectangular matrix, with the triangular playing spaces defining rows of ranks and diagonals and with each two of the triangular playing spaces of alternating shades being paired together at their bases to form pairs of conjugate spaces;

further providing a first group and a second group of player position markers, with the player position markers of the first and second groups respectively having shades closely matching the first and second shades of the triangular playing spaces to provide for differentiation by a first player and a second player, and with each group of player position markers comprising a plurality of different types of player position markers including at least one piece providing for the transposing of at least some other pieces, and with each type of player position marker having a different pattern of movement on the game board and with each group of player position markers comprising like numbers and types;

placing the first and second groups of player position markers upon the board in a starting array, with the first group of player position markers opposite the second group of player position markers;

determining a first player and a second player, with each player respectively alternatingly moving a player position marker of the first group and of the second group and proceeding according to one of the four following steps;

(1) moving one of the player position markers and attempting to gain an advantageous position on the game board;

(2) moving one of the player position markers and capturing a player position marker of the other group of player position markers;

(3) transposing at least one of the player position markers in conjugate spaces on the game board and attempting to gain an advantageous position on the game board;

(4) moving the piece providing for the transposing of at least some other player position markers to cause the transposition of at least one other player position marker thereby and attempting to gain an advantageous position on the game board;

continuing in accordance with the above steps until one of the two players is no longer permitted to move any of the playing pieces for that player, with the winner of the game being the player still being permitted to move one of that player's pieces.

2. The method of playing a board game according to claim 1 including:

providing the game board having a total of 152 triangular playing spaces and having a matrix of eight ranks of playing spaces having seventeen triangular playing spaces in each rank, with two additional opposite ranks having eight triangular playing spaces each.

3. The method of playing a board game according to claim 1 including:

providing a Ra player position marker for each group of player position markers, with each Ra player position marker being limited to moving to an adjacent playing space of closely matching shade to the Ra position marker on each move and further permitted to be checked and checkmated by at least one player position marker of the opposite group of player position markers, thereby precluding movement of the position markers.

4. The method of playing a board game according to claim 3 including:

precluding movement of any player position marker located on a playing space immediately adjacent to a Ra position marker and having a shade different from the Ra position marker.

5. The method of playing a board game according to claim 1 including:

providing at least one Sphynx player position marker for each group of player position markers, with each Sphynx player position marker being permitted to move to a playing space along a rank and diagonals three to four spaces removed from a starting position for the move, and further being permitted to cause the transposition of other player position markers located along the rank and diagonals of the player space to which the Sphynx position marker is moved, for one move thereafter.

6. The method of playing a board game according to claim 1 including:

providing at least one Iynx player position marker for each group of player position markers, with each Iynx player position marker being permitted to move to any playing space along a rank and diagonals from a starting position for the move.

7. The method of playing a board game according to claim 1 including:

providing at least two Mynx player position markers for each group of player position markers, with each Mynx player position marker being permitted to move along a rank and diagonals to any playing space having the same shading from a starting position for the move.

8. The method of playing a board game according to claim 1 including:

providing at least two Lynx player position markers for each group of player position markers, with each Lynx player position marker being permitted to move according to one of the two following steps;

(1) moving laterally along a rank of the game board when the starting position of the move is of the same shading as that of the marker;

(2) moving along a diagonal of the game board when the starting position of the move is of a different shading than that of the marker.

9. The method of playing a board game according to claim 1 including:

providing at least two Jynx player position markers for each group of player position markers, with each Jynx player position marker being permitted to move to one of six spaces defining a hexagonal array about a starting space for the move, with the six spaces each being two spaces removed from the starting space for the move and having the same shading as the starting space for the move.

10. The method of playing a board game according to claim 1 including:

providing at least two Kynx player position markers for each group of player position markers, with each Kynx player position marker being permitted to move to one of twelve spaces defining first and second hexagonal arrays about a space conjugate to the starting space for the move, with six spaces each being two spaces removed from the space conjugate to the starting space for the move and defining the first hexagonal array and six spaces each being four spaces removed from the space conjugate to the starting space for the move and defining the second hexagonal array.

11. The method of playing a board game according to claim 1 including:

providing a plurality of Point player position markers for each group of player position markers, with each Point player position marker being permitted to move according to one of the three following steps;

(1) advancing one space along a diagonal from the starting space for the move having the same shading as the Point player position marker, toward the opposite player starting array, when making non-capturing and capturing moves;

(2) retreating one space along a diagonal from the starting space for the move having a different shading than the Point player position marker, away from the opposite player starting array, when making non-capturing and capturing moves;

(3) moving laterally one space to the side to a space having a different shading than the starting space for the move when making only a capturing move.

12. The method of playing a board game according to claim 11 including:

transposing a Point player position marker when the Point marker has retreated to the board side of its starting array.

13. The method of playing a board game according to claim 11 including:

promoting a Point player position marker to another type of player position marker when the Point marker has advanced to the opposite side of the board.

* * * * *